US007175472B2

(12) United States Patent
Wu et al.

(10) Patent No.: US 7,175,472 B2
(45) Date of Patent: Feb. 13, 2007

(54) FLEXIBLE FLAT CABLE WITH A POSITIONING STRUCTURE AND CONNECTOR USING THE SAME

(75) Inventors: Jung-Hsuan Wu, Taipei (TW); Chia-Ying Chen, Taipei (TW)

(73) Assignee: Compal Electronics, Inc., Taipei (TW)

( * ) Notice: Subject to any disclaimer, the term of this patent is extended or adjusted under 35 U.S.C. 154(b) by 0 days.

(21) Appl. No.: 11/109,626

(22) Filed: Apr. 20, 2005

(65) Prior Publication Data

US 2006/0035516 A1 Feb. 16, 2006

(51) Int. Cl.
*H01R 12/24* (2006.01)

(52) U.S. Cl. ..... 439/492

(58) Field of Classification Search ..... 439/492–499, 439/260

See application file for complete search history.

(56) References Cited

U.S. PATENT DOCUMENTS

| | | | | |
|---|---|---|---|---|
| 5,370,552 | A * | 12/1994 | Chishima et al. | 439/495 |
| 6,089,905 | A * | 7/2000 | Shimmyo et al. | 439/495 |
| 6,371,797 | B1 * | 4/2002 | Kikuchi et al. | 439/496 |
| 6,475,025 | B2 * | 11/2002 | Inoue | 439/495 |
| 2004/0248460 | A1 * | 12/2004 | Masaki et al. | 439/492 |

* cited by examiner

*Primary Examiner*—Ross Gushi
(74) *Attorney, Agent, or Firm*—Bacon & Thomas, PLLC

(57) ABSTRACT

A flexible flat cable with a positioning structure that is disposed on the part or on each side of the flexible flat cable close to a signal contact part, and a connector to be used in conjunction with the flexible flat cable has a corresponding positioning structure on a lid body of a movable lid; when the flexible flat cable forms electrical connection with the connector, the movable lid of the connector shall lead the flexible flat cable to be inserted straightly without slant to remove the shortcoming of bad connection between the flexible flat cable and the connector.

2 Claims, 3 Drawing Sheets

FLEXIBLE FLAT CABLE WITH A POSITIONING STRUCTURE AND CONNECTOR USING THE SAME

BACKGROUND OF THE PRESENT INVENTION

1. Field of the Present Invention

The present invention relates to a flexible flat cable with a positioning structure, and more particularly to a flexible flat cable capable of forming good electrical connection to a corresponding connector.

2. Description of Prior Act

As shown in FIGS. 1 and 2, a prior used connector (10) structure for flexible printed circuits has a lengthwise insulator body (30) and a movable lid (40) sleeved with each other. A groove (31) is disposed on the sidewall at each side of the insulator body (30) and used as a slide way. A stop block (not shown in the figures) is protruded and disposed on an open end of each groove (31). A rabbet (32) and a plurality of rabbet approaches (33) are disposed in the insulator body (30) and each rabbet approach (33) is interlinked with each rabbet (32), so that the front section of each of the plurality of pin terminals (50) is embedded in each rabbet approach (33).

The movable lid (40) has a lid body (41), which has an indentation in the middle and connects to a pressure panel (43) for flexible flat cable (FFC) or flexible printed circuit (FPC) (60) to be inserted in. A forwards protruding side plate (42) is disposed respectively on the left and right sides of the lid body (41) and a slider (not shown in the figures) is protruded and disposed on a front end of each side plate (42).

With the aforementioned structure, when the slider on the front end of each side plate (42) of the movable lid (40) is sleeved in the groove (31) on each side of the insulator body (30), the movable lid (40) and insulator body (30) form a prior art flexible printed circuit (10). The movable lid (40) of the flexible printed circuit (10) can be pulling out and closed.

When pulling out the movable lid (40), the slider disposed on each side plate (42) of the movable lid (40) touches the stop block of the insulator body (30) disposed at the opening end of the groove (31) and, thus, restrict the pull-out distance of the movable lid (40) to avoid separation of the movable lid (40) from the insulator body (30) and make the opening of the rabbet (32) of the insulator body (30) completely exposed for embedding flexible flat cable (FFC) or flexible printed circuit (FPC) (60) in the rabbet (32) of the insulator body (30).

When the flexible flat cable (FFC) or flexible printed circuit (FPC) (60) are embedded in the rabbet (32) of the insulator body (30) and the movable lid (40) is pushed to close on the insulator body (30), the pressure panel (43) of the movable lid (40) stretches into the rabbet (32) of the insulator body (30) and fixes the flexible flat cable (FFC) or flexible printed circuit (FPC) (60) in the rabbet (32) of the insulator body (30) by pressure, which form a electrical connection with the pin terminals (50) and form another electrical connection with the printed circuit board (80) via the pin terminal (50).

However, no positioning function exists between the prior art flexible flat cable (FFC), or flexible printed circuit (FPC) (60), and the prior art flexible printed circuit connector (10). Especially, the movable lid (40) of the prior art flexible printed circuit connector (10) has no positioning structure and is not capable to bring the flexible flat cable (FFC) or flexible printed circuit (FPC) (60) to position and in alignment. With this functional shortcoming, the flexible flat cable (FFC) or flexible printed circuit (FPC) (60) may not be inserted straightly in the right position when being inserted in the rabbet (32) of the insulator body (30), causing bad electrical connection between the pin terminal (50) and a signal contact part of the flexible flat cable (FFC) or flexible printed circuit (FPC) (60).

To solve this problem, an assist line (65) is drawn as a reference on no less than one prior art flexible flat cable (FFC) or flexible printed circuit (FPC) (60). Inserting the flexible flat cable (FFC) or flexible printed circuit (FPC) (60) in right position is determined by visually observing whether the assist line (65) is in alignment with the flexible printed circuit connector (10). However, this approach needs additional costs for drawing the line and erroneous judgment may occur due to careless visual inspection.

SUMMARY OF THE PRESENT INVENTION

The primary objective of the present invention is to provide a flexible flat cable with positioning structure. When the flexible flat cable forms electrical connection with a corresponding connector, the movable lid of the connector leads the flexible flat cable to right position without slant, completely solving the problem of bad electrical connection between the flexible flat cable and the corresponding connector.

The second objective of the present invention is to provide a flexible flat cable with a positioning structure on the part or on each side of the flexible flat cable close to a signal contact part. On a lid body of the movable lid of the connector corresponding to the flexible flat cable is disposed another positioning structure corresponding to the positioning structure of the flexible flat cable to lead the flexible flat cable to be inserted in the right position without being slanted.

The third objective of the present invention is to provide a connector with a positioning structure on the lid body of its movable lid. When a flexible flat cable with a corresponding positioning structure forms electrical connection with the connector, the positioning structure of the connector executes its positioning and aligning function to lead the flexible flat cable to be inserted straightly in the right position without slant.

BRIEF DESCRIPTION OF THE DRAWING FIGURES

DETAILED DESCRIPTION OF THE PREFERRED EMBODIMENTS

Figure 1:
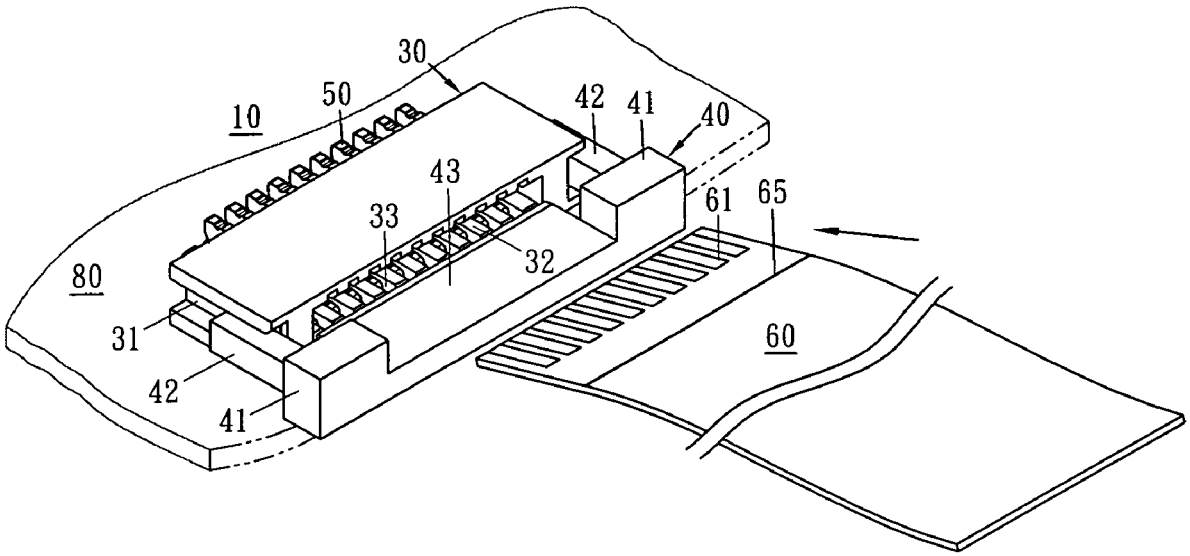
Fig. 1 (prior art)
FIG. 1 shows a structural drawing for prior known flexible printed circuit connector and flexible flat cable.
Figure 2:
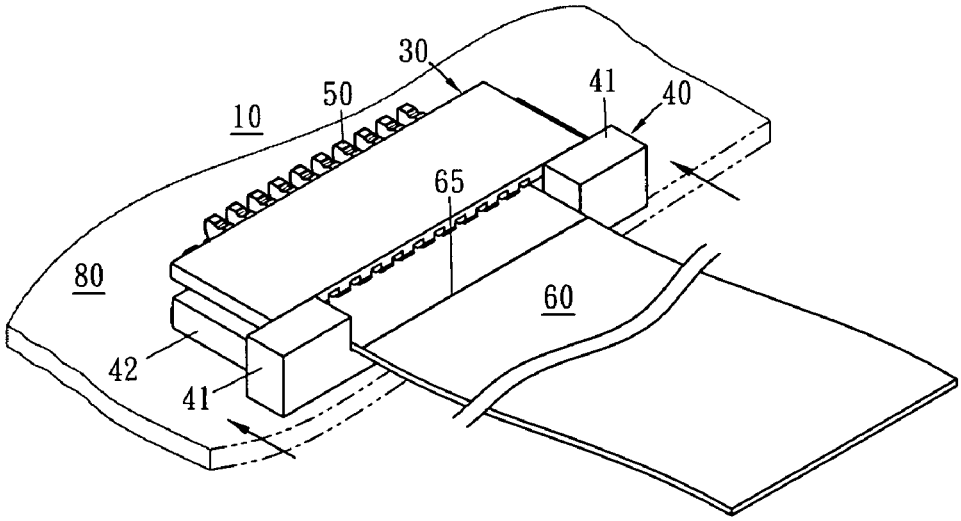
Fig. 2 (prior art)
FIG. 2 shows a use status drawing when the flexible printed circuit forming electrical connection with the flexible flat cable as shown in FIG. 1.
Figure 3:
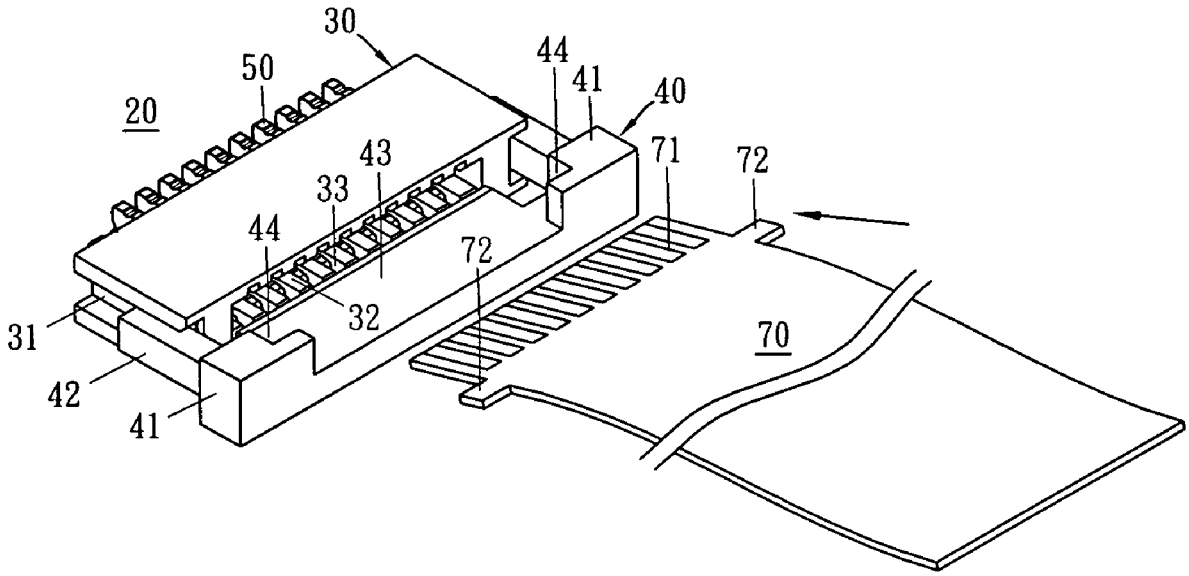
FIG. 3 shows a structural drawing for a flexible printed circuit connector and a flexible flat cable of the present invention.
Figure 4:
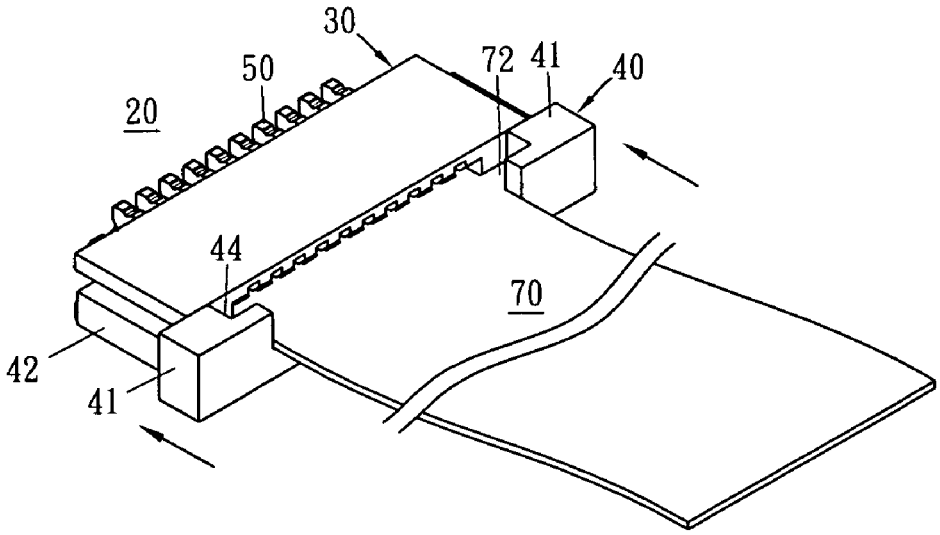
FIG. 4 shows a use status drawing when the flexible printed circuit forming electrical connection with the flexible flat cable as shown in FIG. 3.
Figure 5:
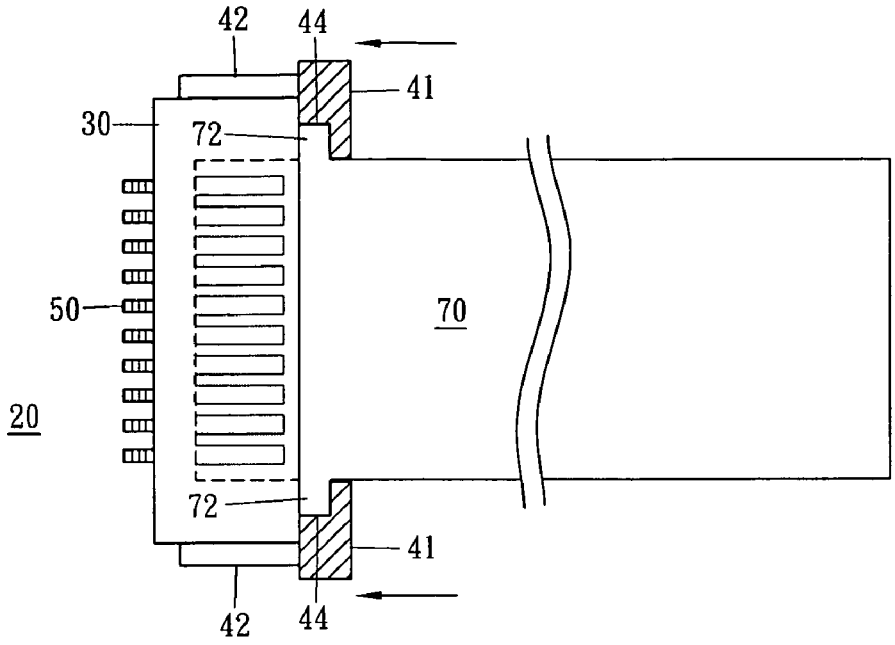
FIG. 5 shows an illustrating drawing to illustrate the flexible flat cable of the present invention has a positioning block which combines with a positioning concave part on the lid body of the flexible printed circuit connector of the present invention to lead the flexible flat cable to be inserted in the right position without slant.
Figure 6:
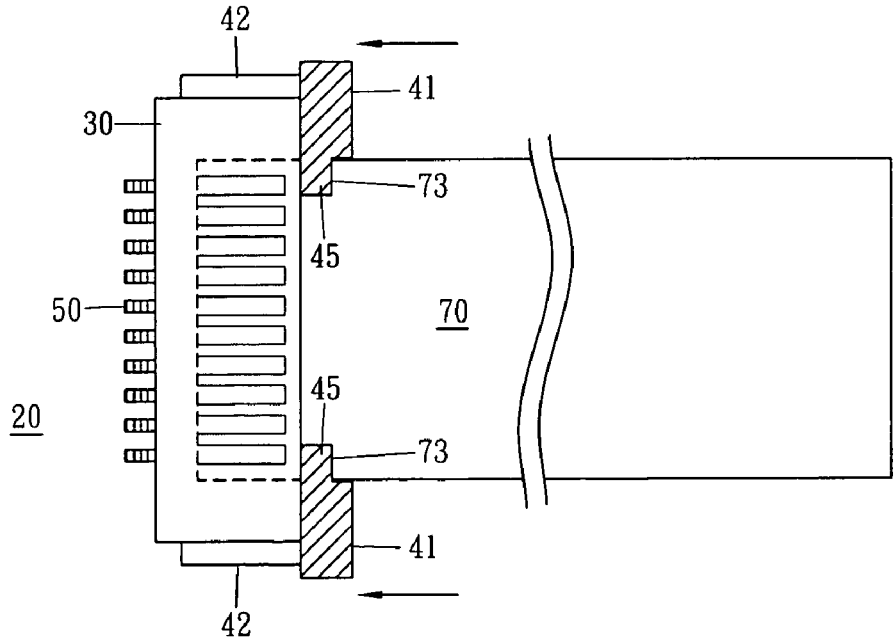
FIG. 6 shows an illustrating drawing to illustrate the flexible flat cable of another embodiment of the present invention has a positioning groove which combines with the positioning convex part on the lid body of the flexible printed circuit connector of the present invention to lead the flexible flat cable to be inserted in the right position without slant.

As shown in FIGS. 3, 5 and 6, the flexible flat cable (70) of the present invention may include a flexible flat cable (FFC) or a flexible printed circuit (FPC), especially the flexible flat cable (70) has positioning structures disposed close to a signal contact part (71) of the flexible flat cable (70).

For example, the flexible flat cable (70) of the present invention has a positioning block (72) is extendedly disposed on each side of the flexible flat cable (70) close to the signal contact part (71) as shown in FIG. 3.

Alternatively, the flexible flat cable (70) of the present invention shall have a positioning groove (73) disposed on the flexible flat cable (70) close to the signal contact part (71) as shown in FIG. 6 to form another embodiment of the invention.

A flexible printed circuit connector (20) of the present invention corresponding to the flexible flat cable (70) in use has a lengthwise insulator body (30), a movable lid (40) and a plurality of pin terminals (50). The movable lid (40) can be pulled out against the insulator body (30) to a limited distance and forms a closure state in conjunction with the insulator body (30).

As the prior known insulator body, the insulator body (30) of the present invention has a groove (31) on each of its side plates. A rabbet (32) and a plurality of rabbet approaches (33) for insertion of the pin terminals (50) are disposed inside the insulator body (30). The movable lid (40) has a lid body (41) with a forward protruding side plate (42) disposed respectively on the left and right side of the lid body (41) and sleeved in the groove (31) of the insulator body (30).

With this structure, the side plate (42) of the movable lid (40) forms a sliding mechanism in conjunction with the groove (31) of the insulator body (30). The lid body (41) of the movable lid (40) has a space in the center that connects to a pressure panel (43). A positioning structure is disposed on the lid body (41) and forms a combination with the positioning structure of the flexible flat cable (70).

As shown in FIG. 3, the flexible flat cable (70) has a positioning block (72) on each side close to but to the rear of the signal contact part (71), and the movable lid (40) has a corresponding positioning notch (44) in the lid body (41), the position notch including perpendicular surfaces for engaging rear and side edges of each positioning block (72).

Alternatively, as shown in FIG. 6, the flexible flat cable (70) shall have a positioning groove (73) on the flexible flat cable (70) close to but to the rear of the signal contact part (71) and the movable lid (40) has a corresponding positioning shoulder (45) on the lid body (41), said shoulders consisting of projections extending from the lid body in a direction transverse to the moving direction of the movable lid.

As shown in FIGS. 3 to 6, when the flexible flat cable (70) forms electronic connection with the corresponding connector (20), the positioning structure of the flexible flat cable (70) is wedged and, thus, restricted and positioned by the lid body (41) of the movable lid (40) of the connector (20), so that the signal contact part (71) of the flexible flat cable (20) is aligned without slant.

As a result, when the movable lid (40) of the connector (20) forms a closure state in conjunction with the insulator body (30), the signal contact part (71) of the flexible flat cable (70) is led into the rabbet (32) of the insulator body (30) and inserted in the right position, ensuring good electrical connection with the pin terminal (50) of the connector.

Although the present invention has been disclosed and illustrated with reference to particular embodiments, the scope of the appended claims of the present should be extended to the principles involved are susceptible for use in numerous other embodiments that will be apparent to persons skilled in the art.

What is claimed is:

1. A connector comprising an insulator body having a groove on each side, and a rabbet and a plurality of rabbet approaches being disposed in said insulator body, a movable lid having a lid body with a space in a center and a forward protruding side plate on each side thereof, said side plate being sleeved in the insulator body, and a plurality of pin terminals installed inside the insulator body; characterized in that a pair of positioning notches including perpendicular surfaces for engaging rear and side edges of corresponding positioning blocks on opposite sides of a flexible flat cable are disposed on the lid body of said movable lid, said positioning blocks being situated close to but to the rear of a signal contact part of the cable.

2. A connector comprising an insulator body having a groove on each side, and a rabbet and a plurality of rabbet approaches being disposed in said insulator body, a movable lid having a lid body with a space in a center and a forward protruding side plate on each side thereof, said side plate being sleeved in the insulator body, and a plurality of pin terminals installed inside the insulator body; characterized in that a pair of positioning shoulders for engaging corresponding positioning grooves on opposite sides of a flexible flat cable are disposed on the lid body of said movable lid, said positioning shoulders consisting of extensions of the lid body extending in a direction transverse to a movement direction of the movable lid, said positioning grooves being situated close to but to the rear of a signal contact part of the cable.

* * * * *